US008435029B2

(12) United States Patent
Masterson et al.

(10) Patent No.: US 8,435,029 B2
(45) Date of Patent: May 7, 2013

(54) TOUCHLESS FILL LARGE FLAME TORCH

(75) Inventors: Daniel Masterson, Geneva, IL (US); Robert Giocolo, Naperville, IL (US); Paul Golko, Crystal Lake, IL (US); John Uselding, Port Washington, WI (US); William Tobin, Franklin, WI (US); Danny Luk, Kwai Chung (CN)

(73) Assignee: Lamplight Farms Incorporated, Menomonee Falls, WI (US)

( * ) Notice: Subject to any disclaimer, the term of this patent is extended or adjusted under 35 U.S.C. 154(b) by 1425 days.

(21) Appl. No.: 12/039,505

(22) Filed: Feb. 28, 2008

(65) Prior Publication Data

US 2009/0220904 A1 Sep. 3, 2009

(51) Int. Cl.
*F23D 3/04* (2006.01)
*F23D 3/24* (2006.01)
*F23D 3/18* (2006.01)

(52) U.S. Cl.
USPC ..... 431/312; 431/320; 431/321; 431/323

(58) Field of Classification Search ..... 431/320, 431/321, 323, 312
See application file for complete search history.

(56) References Cited

U.S. PATENT DOCUMENTS

| | | | | |
|---|---|---|---|---|
| 44,441 | A * | 9/1864 | Neilson | |
| 203,043 | A | 4/1878 | Hillegass | |
| 243,134 | A | 6/1881 | Hinrichs et al. | |
| 401,075 | A | 4/1889 | Seltzer | |
| 1,062,886 | A * | 5/1913 | Carlson | 431/230 |
| 1,121,175 | A | 12/1914 | Dow | |
| 2,122,624 | A | 7/1938 | Sauer | |
| 2,217,970 | A | 10/1940 | Shearman et al. | |
| 2,313,784 | A | 3/1943 | Then | |
| 2,684,182 | A | 7/1954 | Gey | |
| 2,832,404 | A * | 4/1958 | Thorpe | 431/198 |
| 2,836,043 | A | 5/1958 | Spethmann | |
| 3,364,704 | A | 1/1968 | Bernstein | |
| 3,385,084 | A | 5/1968 | MacDonald | |
| 3,531,228 | A | 9/1970 | Reese | |
| D219,062 | S | 10/1970 | Kozoil | |
| D225,674 | S | 12/1972 | Reese | |
| 3,727,810 | A | 4/1973 | Douty | |
| 4,069,946 | A | 1/1978 | Flider | |

(Continued)

FOREIGN PATENT DOCUMENTS

| | | | |
|---|---|---|---|
| DK | 176195 B1 * | 11/2006 | |
| FR | 2734888 | 6/1996 | |

(Continued)

OTHER PUBLICATIONS

Pipe-Line Denmark, "Elipse Advanced Burning Control", Published at http://www.monalisa.no/pipeline/pdf/17.pdf.

(Continued)

*Primary Examiner* — Kenneth Rinehart
*Assistant Examiner* — William Corboy
(74) *Attorney, Agent, or Firm* — Fellers, Snider, Blankenship, Bailey & Tippens, P.C.

(57) ABSTRACT

An apparatus having a fuel container, a flame bowl, and a wick holder disposed proximate the flame bowl is disclosed. An open fuel filling port disposed in the flame bowl prevents entry of ignition sources into the fuel container but allows for the flow of liquid thereinto, whereby a user of the torch may refuel the torch without need to touch the torch.

8 Claims, 13 Drawing Sheets

U.S. PATENT DOCUMENTS

| | | | | |
|---|---|---|---|---|
| 4,526,530 | A * | 7/1985 | Menter et al. | 431/34 |
| 4,792,054 | A | 12/1988 | Weidman | |
| 5,083,916 | A | 1/1992 | Glennon et al. | |
| 5,205,730 | A | 4/1993 | Capdeville | |
| 5,269,432 | A | 12/1993 | Beckertgis | |
| 5,405,262 | A | 4/1995 | Appel | |
| 5,555,993 | A | 9/1996 | Borkowski et al. | |
| 5,584,283 | A | 12/1996 | Messina | |
| D404,507 | S | 1/1999 | Palmer et al. | |
| 5,902,101 | A | 5/1999 | Palmer et al. | |
| 5,980,241 | A | 11/1999 | Schirneker | |
| 5,996,653 | A | 12/1999 | Piccinino, Jr. | |
| 6,010,332 | A | 1/2000 | Lee et al. | |
| D450,140 | S | 11/2001 | Donley | |
| 6,360,738 | B1 | 3/2002 | Brooks | |
| 6,468,072 | B2 | 10/2002 | Shook | |
| 6,663,258 | B1 | 12/2003 | Kanter | |
| 6,663,838 | B1 | 12/2003 | Soller et al. | |
| 6,739,471 | B2 | 5/2004 | Goetz et al. | |
| 6,746,235 | B1 * | 6/2004 | Aszenbrenner et al. | 431/320 |
| 6,780,382 | B2 | 8/2004 | Furner et al. | |
| 6,857,869 | B1 | 2/2005 | Sun | |
| 7,056,113 | B2 | 6/2006 | Bachinski et al. | |
| 7,090,142 | B2 | 8/2006 | Rantzen | |
| 7,156,653 | B1 | 1/2007 | Demars | |
| 7,232,550 | B1 | 6/2007 | Rodgers et al. | |
| 7,247,017 | B2 | 7/2007 | Furner | |
| 2002/0164554 | A1 | 11/2002 | Kisch et al. | |
| 2004/0229180 | A1 | 11/2004 | Furner | |
| 2006/0057530 | A1 | 3/2006 | Kuricek et al. | |
| 2006/0144599 | A1 | 7/2006 | Leinemann | |
| 2006/0183065 | A1 * | 8/2006 | Konkle | 431/320 |
| 2006/0199129 | A1 | 9/2006 | Konkle, Jr. | |
| 2006/0251997 | A1 | 11/2006 | Schulte et al. | |
| 2007/0015097 | A1 | 1/2007 | Baker | |

FOREIGN PATENT DOCUMENTS

| | | |
|---|---|---|
| JP | 06331133 | 11/1994 |
| WO | WO 03106895 | 12/2003 |
| WO | WO 2004108219 | 12/2004 |

OTHER PUBLICATIONS

Pipe-Line Denmark, "The Torch Master Brochure", Published at: http://www.pipe-line.dk/pdf/English2007WEB.pdf.

* cited by examiner

TOUCHLESS FILL LARGE FLAME TORCH

FIELD OF THE INVENTION

This disclosure is related to liquid fueled torches in general and, more specifically, to a touchless fill liquid fueled torch with a large flame.

BACKGROUND OF THE INVENTION

Patio torches, also know as lawn torches or garden torches, may be used to provide lighting or decoration. Sometimes, scented oils or insect repellent oils are burned in the patio torches for additional effect. A torch may include a refillable canister that accepts liquid fuel. Although, for safety reasons the torches are not usually filled when ignited, filling liquid fueled torches can be inconvenient. The top of the canister containing the charred and often sooty wick must be removed. A funnel must be used to prevent spilling of the flammable fuel when filling the canister. The top of the canister must then be handled a second time in order to replace it.

In addition to filling and other maintenance problems, the actual usefulness of the torches, both in terms of light or aroma given off and the ability to repel pests, may be less than desirable. The wick is often too small, relatively speaking, to provide an effective amount of combustion. Even with larger diameter wicks or wicks that are extendable to create a larger surface area, air and flame control may become problematic resulting in a flame that may still be too small, too smoky, or both.

What is needed is a device for addressing the above and related problems.

SUMMARY OF THE INVENTION

The invention of the present disclosure, in one embodiment thereof, comprises an apparatus having a fuel container, a flame bowl, and a wick holder disposed proximate the flame bowl. An open fuel filling port is disposed in the flame bowl, the port having means for preventing entry of ignition sources into the fuel container but allowing for the flow of liquid thereinto, whereby a user of the torch may refuel the torch without need to touch the torch.

In one embodiment, the open fuel filling port comprises at least one baffled barrier. The means for preventing entry of ignition sources may comprise a foam insert. In another embodiment, the means for preventing entry of ignition sources comprises steel wool, ball bearings, packing material, or wicking material. The torch may further comprise a ventilation tube connecting the fuel container to the flame bowl. The torch may also have a fuel full indicator.

In another aspect thereof, the invention of the present disclosure comprises an apparatus having a fuel container, a flame bowl, and a fill port accessible through the flame bowl, and having a restriction preventing the free flow of gases into or out of the fuel container, whereby the fuel port is always accessible for filling without need for opening. The restriction of the fill port may comprise a plurality of baffled barriers. In another embodiment, the restriction comprises a fill trap retaining a quantity of liquid fuel that blocks vapor flow. In another embodiment, the restriction comprises a fill tube extending into the fuel container below a minimum operational fuel level.

The invention of the present disclosure, in another embodiment thereof, comprises an apparatus with a fuel canister, a flame bowl, and a neck joining the fuel canister and the flame bowl. The neck contains a wick holder and a surrounding fuel filling port, the fuel filling port being operable to allow filling of the fuel canister without manipulation of the torch and to control the exit of fuel vapors from the fuel canister while preventing entry of ignition sources into the fuel canister. The fuel filling port may further comprise a baffled floor connecting to the wick holder, a doubled-walled fuel flow barrier connecting to a periphery of the baffled floor, an inner wall of the barrier being solid and an outer wall of the barrier facing an inner portion of the neck and being baffled on a portion thereof, and a baffled shelf below the baffled floor having a passage for passing the wick therethrough into the fuel canister.

DETAILED DESCRIPTION OF THE PREFERRED EMBODIMENTS

Figure 1:
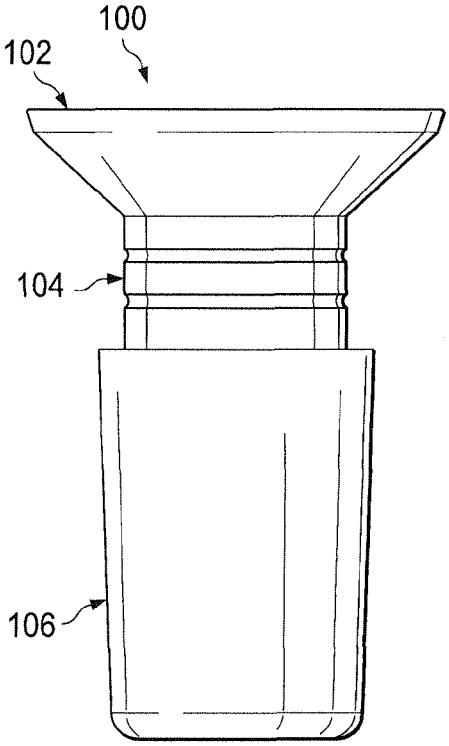
FIG. 1 is a side view of a large flame patio torch according to aspects of the present disclosure.

Referring now to FIG. 1, a side view of a large flame patio torch according to aspects of the present disclosure is shown. Although the torch 100 is referred to as a patio torch, for purposes of the present disclosure this term is synonymous with any type of recreational, decorative, or insect-repellent torches such as garden torches, lawn torches, or decorative torches. As will be shown in greater detail below, the torch 100 may be used as an insert with a stand or other display device to create a torch assembly. In some embodiments, the torch 100 is used as a stand-alone item.

The major components of the torch 100 seen in FIG. 1 comprise a funnel, bowl, or flame guard 102, a neck 104, and a canister 106. These pieces may be formed integrally or may be formed separately and attached. In one embodiment, each of these components is made from rolled or stamped sheet metal that may be spot welded or glued together. In other embodiments, a more durable build may be accomplished by using cast or machined pieces. In some embodiments, some parts of the torch 100 may be plastic or another material.

Figure 2:
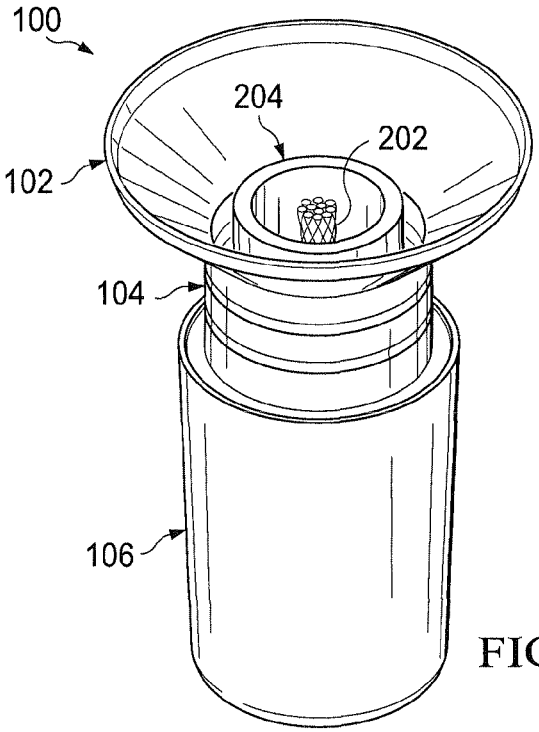
FIG. 2 is a perspective view of the patio torch of FIG. 1

Referring now to FIG. 2, a perspective of the patio torch 100 of FIG. 1 is shown. From this viewpoint, the funnel or bowl 102 can be seen, as well as the neck 104 and canister 106. From this viewpoint, the wick 202 can be seen. The wick 202 may be a cotton wick, a fiberglass wick, a polyester wick, or another type of wick using these or other materials and/or combinations thereof. Although only a single wick 202 is shown in, the present disclosure is not so limited. Multiple wicks may be provided that are capable of simultaneous or selective operation. Near the bottom of the funnel 102, a flow barrier 204 can be seen. The function of the flow barrier 204 will be described in greater detail below.

Figure 3:
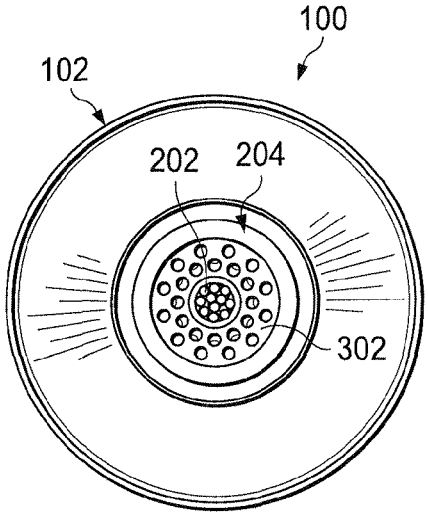
FIG. 3 is a superior view of the patio torch of FIG. 1.

Referring now to FIG. 3, a superior view of the patio torch 100 of FIG. 1 is shown. The view of FIG. 3 illustrates the appearance of the torch 100 looking down through the funnel 102. It can be seen that in the center of the funnel (down in the neck 104) is a baffled floor 302. The wick 202 can be seen disposed in approximately the center of the baffled floor 302. The flow barrier 204 surrounds the baffled floor 302. In this and the other embodiments of the present disclosure, the funnel 102 and neck 104 and the components therein operate as a touch-free fueling port. That is, the torch 100 may be fueled without any need to handle or otherwise touch the torch.

Figure 4:
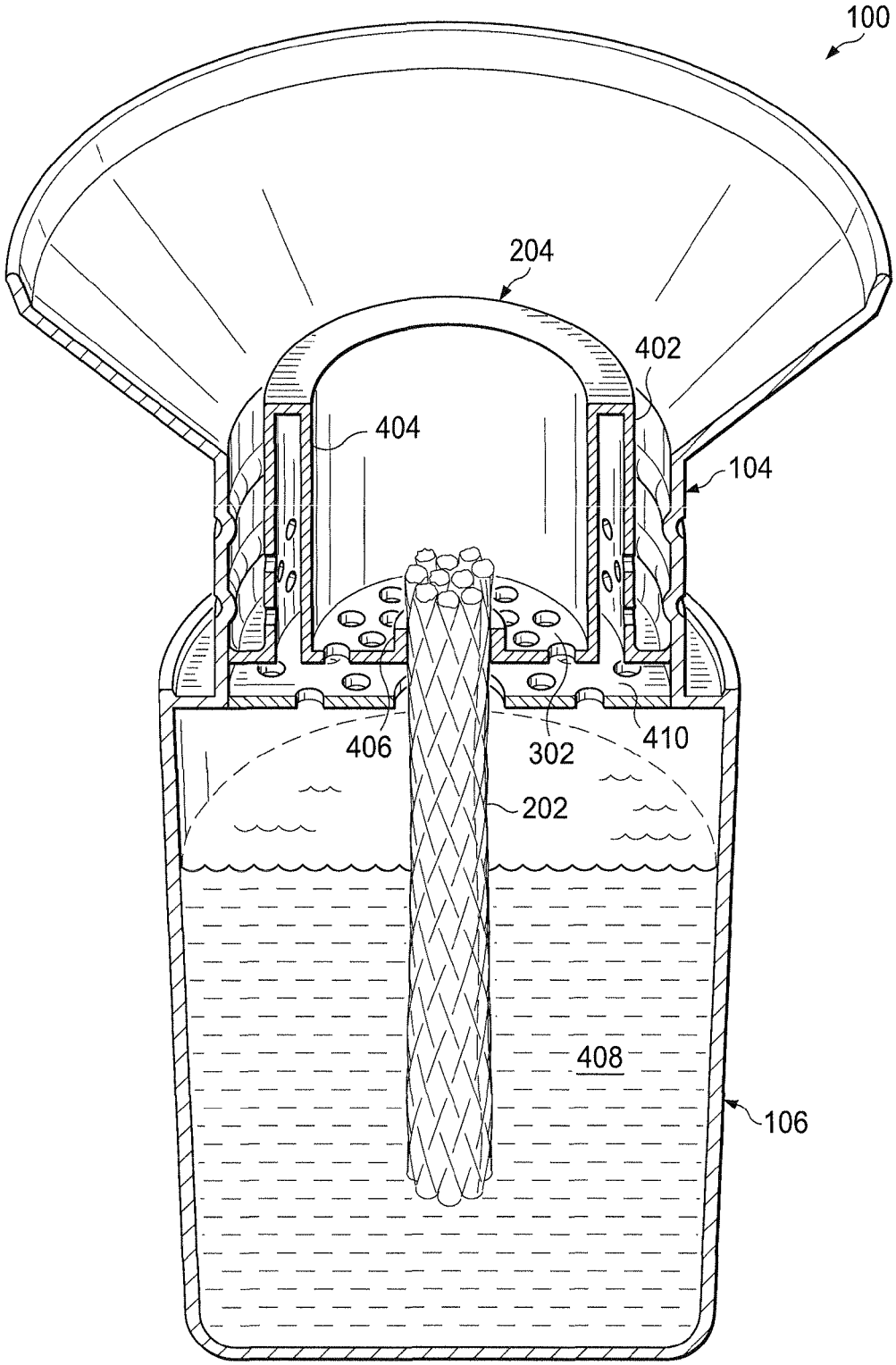
FIG. 4 is a perspective cutaway view of the patio torch of FIG. 1.

Referring now to FIG. 4, a perspective cutaway view of the patio torch 100 of FIG. 1 is shown. From the side view, it can be seen that the flow barrier 204 from proximate the canister 106 through at least a substantial portion of the neck 104 and possibly into the funnel 102. The flow barrier 204 of the present embodiment comprises a baffled outer flow barrier wall 402 and a solid inner flow barrier wall 404. It can be seen that any fluid entering the funnel 102 and traveling down the neck 104 will flow to either side of the flow barrier 204. If fluid to the outside of the flow barrier 204 adjacent to the baffled outer flow barrier wall 402, the baffles and the wall 402 will allow the fluid to pass. If fluid flows adjacent to solid inner flow barrier wall 404, the baffled floor 302 will allow the fluid to pass. It can be seen that beneath the baffled floor 302 and the flow barrier 204 is a baffled shelf 410. Similar to the baffled floor 302 and the baffled outer flow barrier wall 402, the baffled shelf 410 will allow liquids such as fuel poured into the torch 100 to pass into the canister 106 substantially unimpeded. Therefore, any time that liquid fuel is poured into the torch 100, whether directly onto the baffled floor 302 or elsewhere in the funnel 102, the liquid will pass through the neck 104 of the torch 100 and into the canister 106.

Figure 15:
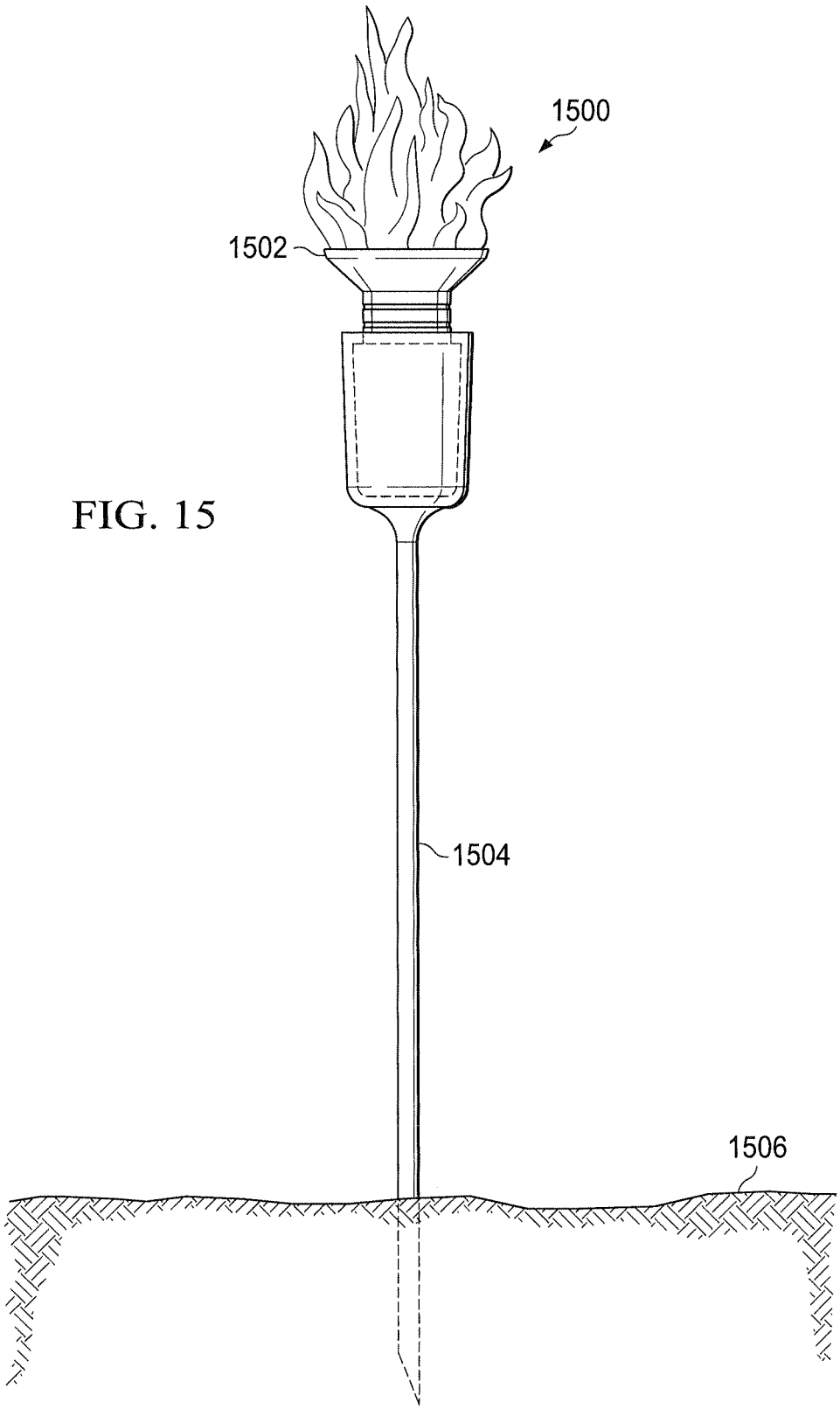
FIG. 15 is an illustration of a large flame patio torch in operation according to aspects of the present disclosure.

It can be seen that the baffled floor 302 also provides a wick holder or collar 406 for retaining the wick 202 at an appropriate height. The wick holder 406 may be sized to retain the wick 202 in a friction fit. In the present embodiment, the baffled shelf 410 does not necessarily come into contact with the wick 202, but may in some embodiments. Liquid fuel 408 is illustrated in the canister 106. As described, the various baffled components in the neck 104 of the torch 100 allow liquid fuel 408 to be readily poured into the canister 106 and into the torch 100. In the present embodiment, the baffled openings remain open even during operation of the torch 100 such that the wick 202 may be extinguished and the fuel 408 refilled without the need to open or close the torch 100 in any manner. As illustrated in FIG. 15, the shape of the neck 104 and funnel 102 allow the flame produced by ignition of the wick 202 to substantially fill the funnel or bowl 102. This results in a higher output of light and/or insect repellent capability.

The baffling of the outer wall 402, the floor 302, and the shelf 410 allow for the passage of liquids, such as the fuel 408, in a substantially unimpeded manner. Vapors escaping from the canister 106 may also pass through the various baffles. However, the baffling is constructed such that vapors escape only in a relatively controlled fashion. The vapors may be consumed by the flame in the funnel 102. However, the baffled components will prevent ignition sources from entering the canister 106, which could result in the unintentional burning of the fuel 408 within the canister 106. Ignition sources may include flames or embers from the wick 202, the lighter or match used to ignite the torch 100, heated surfaces, or other sources.

It will be appreciated that the construction of the torch 100 in general, and the baffled outer flow barrier wall 402, the baffled floor 302, and the baffled shelf 410 provide means for preventing the entry of any ignition source into the fuel supply 408 of the canister 106. It may also be said that these mechanisms provide means for the controlled escape of the combustible vapors arising from the fuel supply 408. As discussed in greater detail below, other embodiments will provide other structures and means for providing this functionality.

Figure 5:
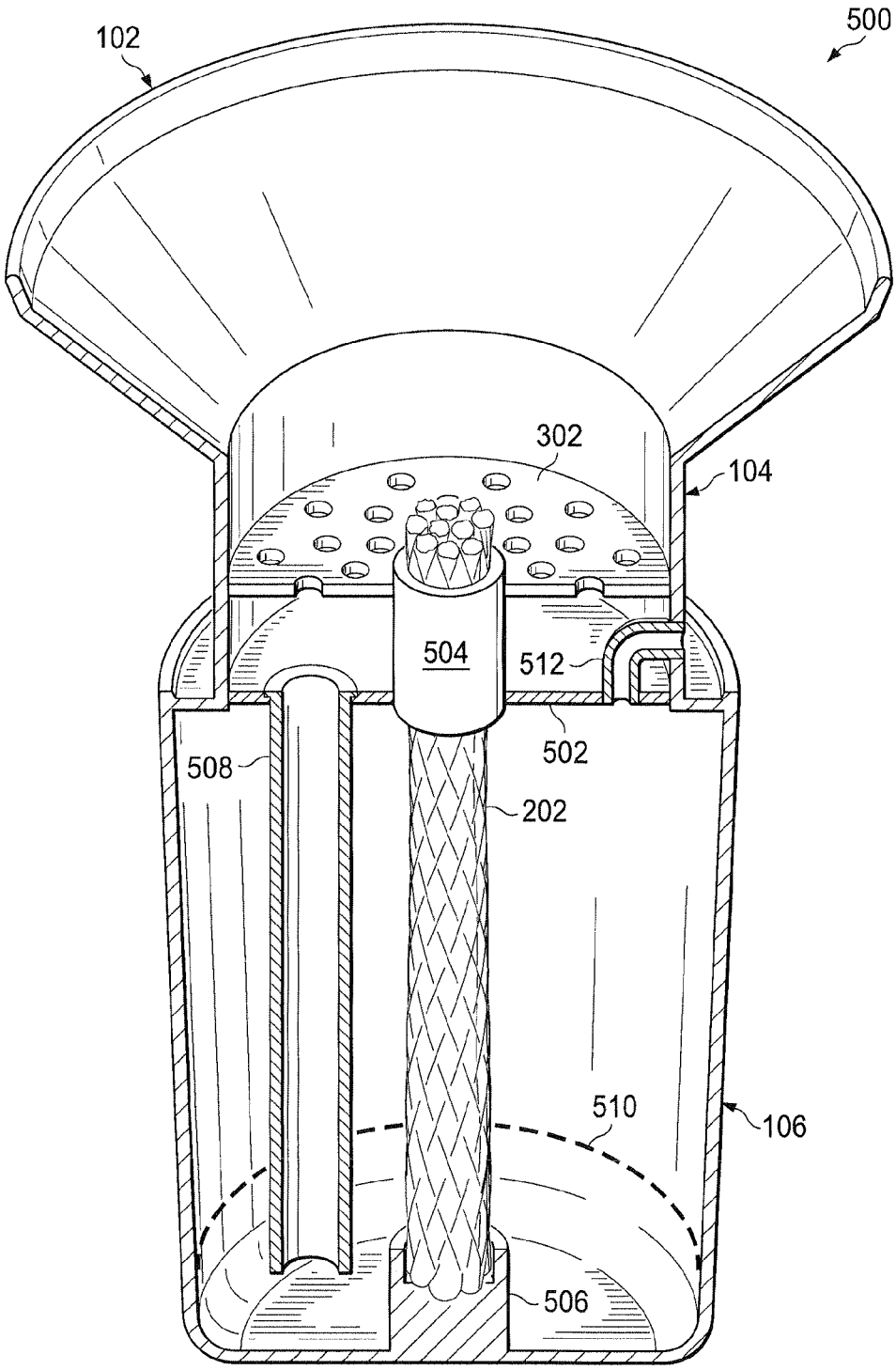
FIG. 5 is a perspective cutaway view of another large flame patio torch according to aspects of the present disclosure.

Referring now to FIG. 5, a perspective cutaway view of another large flame patio torch according to aspects of the present disclosure is shown. The torch 500 provides a funnel 102 and a neck 104 connecting to a canister 106. A collar 504 is provided for retaining the wick 202. Within the neck 104, a baffled floor 302 is provided. In the present embodiment, beneath the baffled floor 302 is a solid floor or shelf 502. It can be seen that any liquids, such as fuel, entering the funnel 102 must pass through the baffled floor 302. The shelf 502 provides passage into the canister 106 via a fill tube 508. Thus, when being filled, the torch 500 passes fluids through the baffled floor 302 onto the shelf 502 and down through the fill tube 508 into the canister 106. When in an operating condition, the torch 500 of the present embodiment is designed such that the fill tube 508 will always be below the level of fuel in the canister 106.

A stand 506 is provided for preventing the wick 202 from entering into the canister 106 below the lowest level of the fill tube 508. In the present embodiment, the line 510 shows the minimum amount of liquid fuel that must be in the canister 106 for continued operation. The stand 506 may be integrated into the canister 106 or may be a separate component. A vent 512 passes from the shelf 502 to the outside of the neck 104 away from the funnel 102. Thus, fuel vapors from the canister 106 are allowed to vent in a controlled manner. It can be appreciated that the present embodiment provides means for touchless refueling, means for preventing ignition sources from entering into the canister 106, and means for adequate ventilation of the fuel supply within the canister 106.

Figure 6:
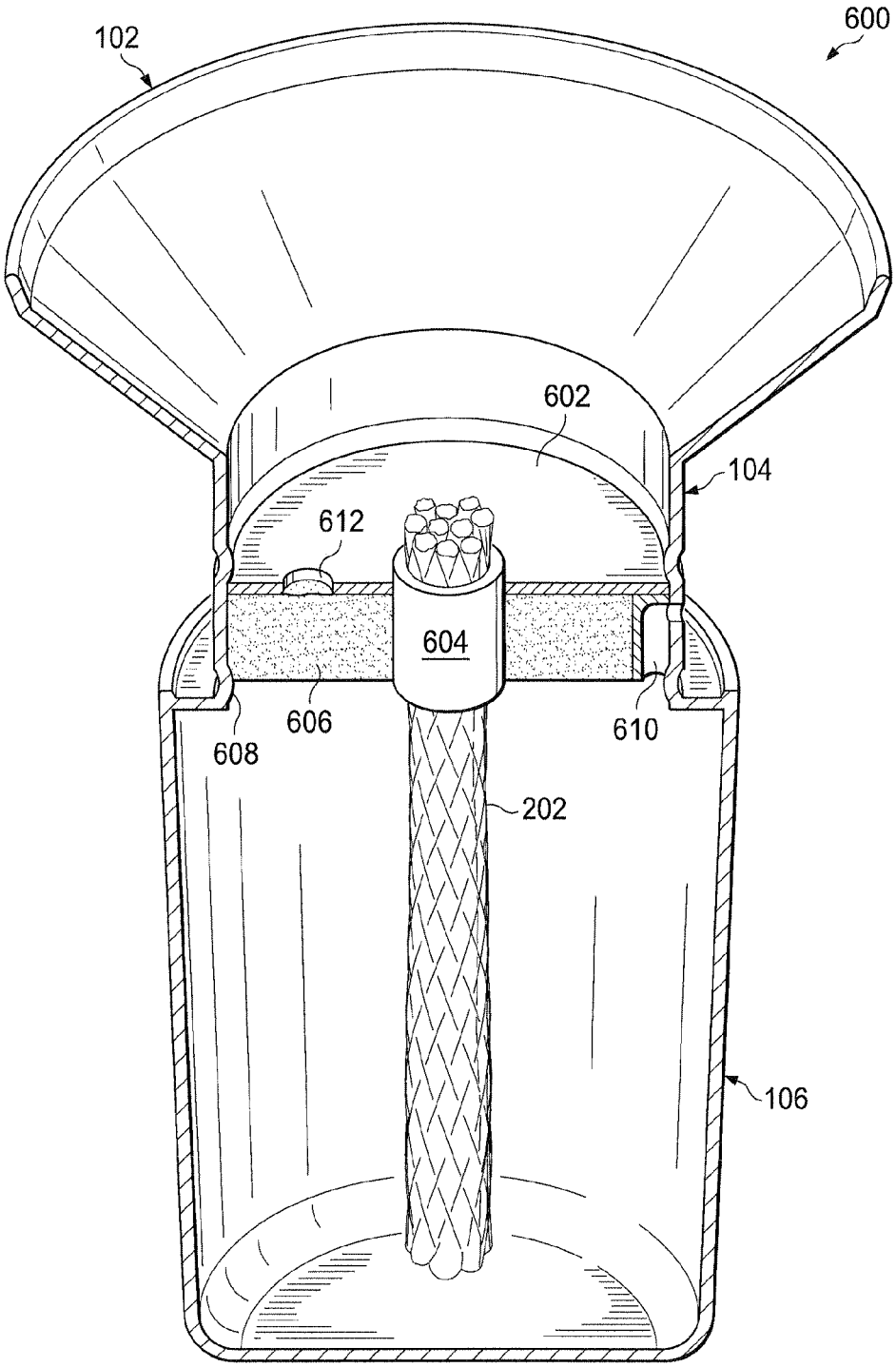
FIG. 6 is a perspective cutaway view of another large flame patio torch according to aspects of the present disclosure.

Referring now to FIG. 6, a perspective cutaway view of another large flame patio torch according to aspects of the present disclosure is shown. The present embodiment once again provides a funnel 102 attaching to a neck 104, which attaches to the canister 106. Below the funnel 102 in the neck 104 of the torch 600 is a floor 602. The floor 602 attaches to a collar 604 which serves as a wick holder for the wick 202. A foam insert 606 is provided below the floor 602 and may be held in place by one or more crimps 608.

The foam insert 606 serves as a barrier that is relatively liquid permeable but relatively gas impermeable, particularly when wetted by liquid fuel. Thus the foam insert provides a liquid permeable transport path that is also capable of controlling escaping vapor. Any type of foam filler, packing materials, or other porous material that is resistant to the fuel used in the torch 600 can be used to construct the foam insert 606. The foam insert 606 in the present embodiment substantially fills the entire perimeter of the neck 104. The foam insert 606 will be cut away to allow passage of the wick 202 and the collar 604. The foam insert 606 may also have one or more cut away portions for the vent tube 610 for allowing passage of fuel vapors from the canister 106 to the outside of the torch 600.

The crimp 608 may be continuous around the neck 104 or may be a series of discrete crimps at various locations. One function of the crimp 608 is to prevent the foam insert 606 from falling from the neck 104 down into the canister 106.

In order to facilitate the touch free pouring of fuel into the torch 600, the floor 602 provides a fill hole 612. Fluids poured into the funnel 102 will be drawn into the fill hole 612 by gravity and through the foam insert 606 down into the canister 106. Therefore, it can be seen that the embodiment of FIG. 6 provides means for refilling the torch 600 without touching the torch 600 and also provides means for venting fuel fumes and means for preventing entry of ignition sources into the canister 106.

Figure 7:
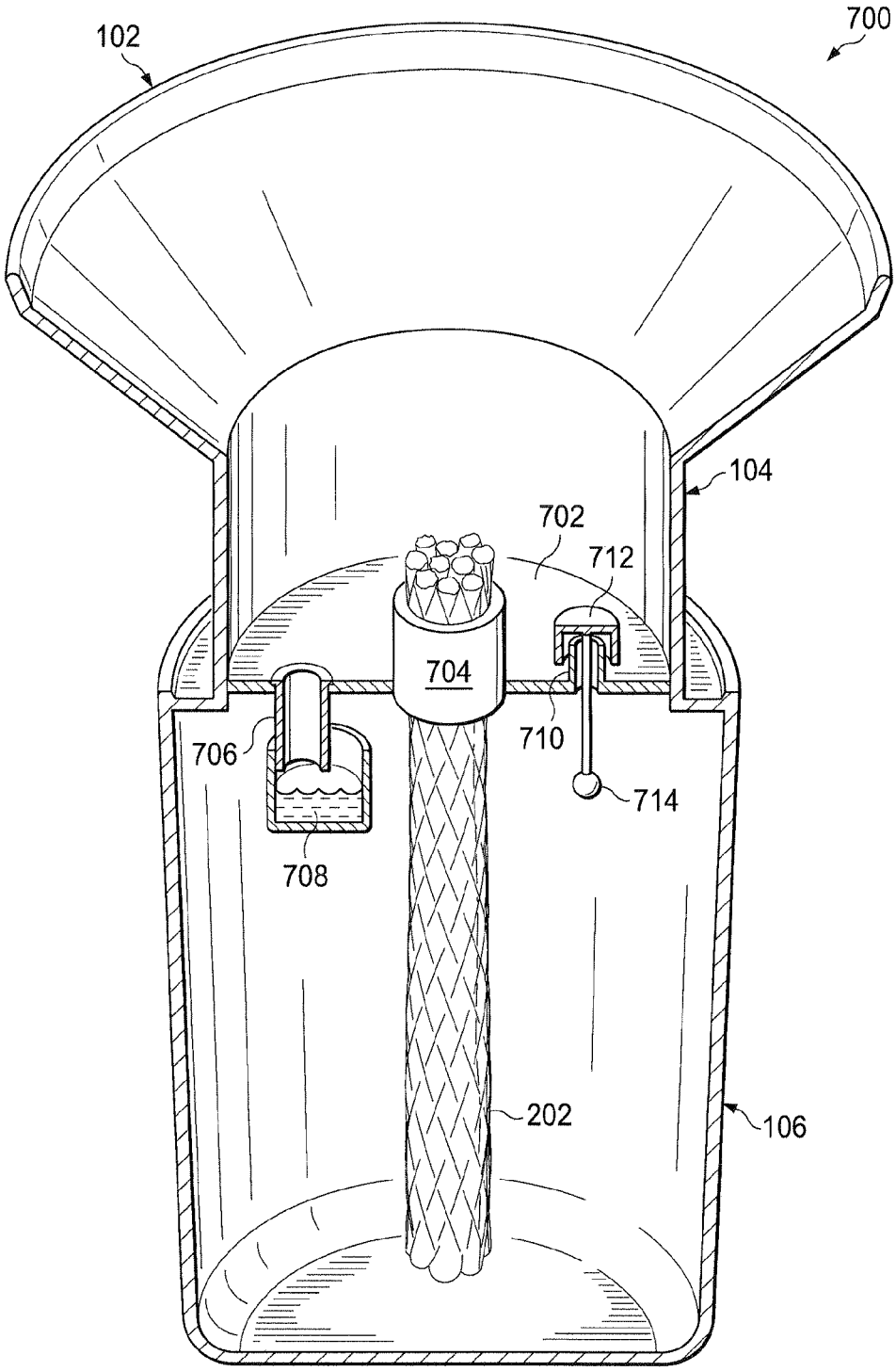
FIG. 7 is a perspective cutaway view of another large flame patio torch according to aspects of the present disclosure.

Referring now to FIG. 7, a perspective cutaway view of another large flame patio torch according to aspects of the present disclosure is shown. Externally, the torch 700 is similar to those previously described. A funnel 102, a neck 104, and a canister 106 are provided. In the neck 104 of the torch 700, a floor 702 defines or attaches to a collar 704 that may function as a wick holder for the wick 202. To allow fuel into the canister 106, a trap 706 may be used. The trap 706 allows fluid to be poured therethrough and into the canister 106 while a small volume of liquid fuel 708 is retained by the trap 706. This small volume of liquid fuel 708 serves to seal the neck 104 and funnel 102 of the torch 700 from vapor exchange with the canister 106. The trap 706 also prevents entry of ignition sources into the canister 106.

In addition to the trap 706, the floor 702 also provides a ventilation tube 710. In the present embodiment, the ventilation tube 710 is covered by a cap 712. The cap 712 in the present embodiment attaches to a float 714. In the present embodiment, the float 714 will elevate the cap 712 when the fuel level in the canister 106 reaches the float 714. Thus, the present embodiment also provides an indication of a full fuel canister 106. The capped ventilation tube 710 also provides means for excessive vapors to escape from the canister 106 into the neck and funnel 102, but prevents ignition sources from entering the canister 106. Thus, the present embodiment also provides means for touch free fueling, ventilation, and for preventing ignition sources from entering the canister 106.

Figure 8:
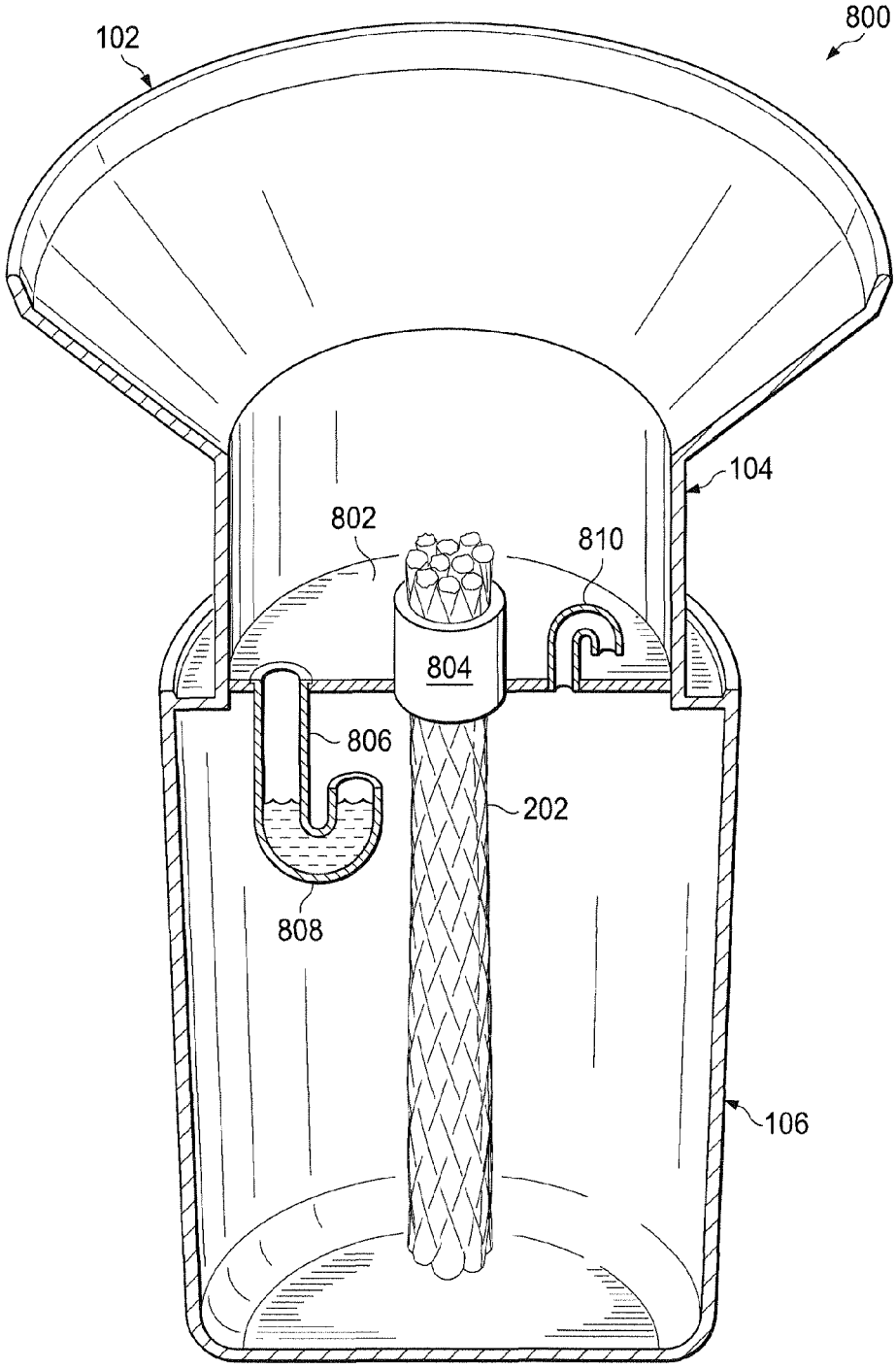
FIG. 8 is a perspective cutaway view of another large flame patio torch according to aspects of the present disclosure.

Referring now to FIG. 8, a perspective cutaway view of another large flame patio torch according to aspects of the present disclosure is shown. The torch 800 of FIG. 8 provides a funnel 102, attaching to a neck 104, attaching to a fuel canister 106. A floor 802 is once again provided in the neck 104. The floor 802 defines or otherwise attaches to a collar 804 used as a wick holder in the present embodiment. A fill trap 806 is provided on the floor 802. The fill trap 806 allows the entry of fluids poured into the funnel 102 and neck 104 into the canister 106. The trap 806 retains a small amount of fluid 808 that prevents excessive fuel vapors from leaving the canister 106. A vent tube 810 is provided on the floor 802 for allowing vapors to escape from the fuel canister 106 in a controlled fashion. As shown, the vent tube 810 may be shaped to provide adequate ventilation while preventing entry of the flame from the wick 202 or other ignition sources into the canister 106. Thus, the embodiment of FIG. 8 provides a means for refueling the torch 800 without touching the torch 800 while also providing a means of ventilation preventing entry of ignition sources into the canister 106.

Figure 9:
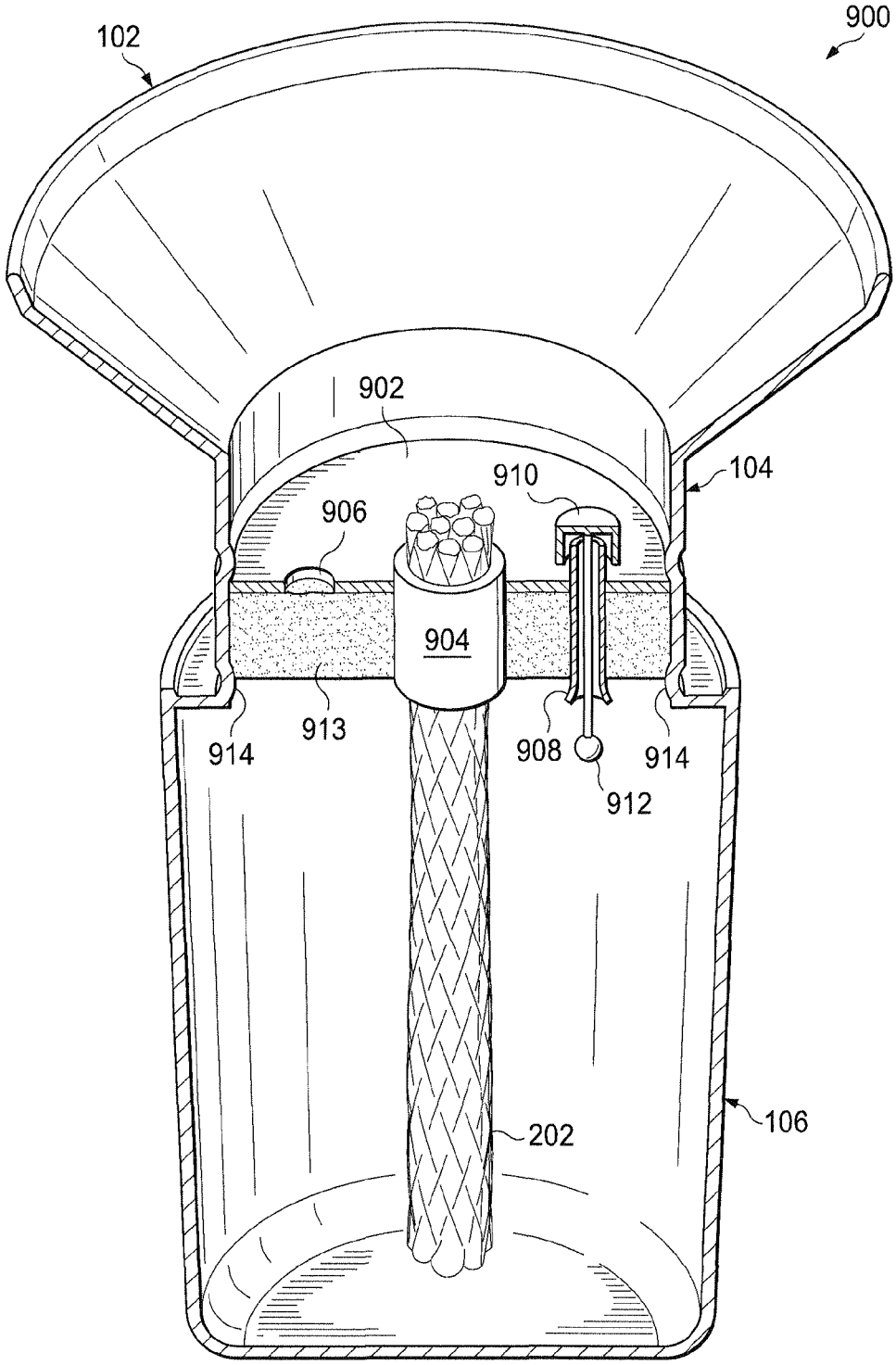
FIG. 9 is a perspective cutaway view of another large flame patio torch according to aspects of the present disclosure.

Referring now to FIG. 9, a perspective cutaway view of another large flame patio torch according to aspects of the present disclosure is shown. Once again, the torch 900 provides a funnel 102, connected to a neck 104, connected to a fuel canister 106. It can be seen that the torch 900 combines certain features of some of the torches previously described. A floor 902 defines or otherwise attaches to a collar 904 functioning as a wick holder. The floor 902 provides a fill hole 906 for allowing passage of liquids such as fuel poured into the funnel 102, or neck 104, into the canister 106. A foam insert 913 may be held in place below the floor 902 by one or more crimps 914. As before, the crimps 914 may be continuous indentations about the circumference of the neck 104 or may be formed only in selected places on the neck 104, funnel 102, and/or canister 106. The foam insert 913 may be any porous material resilient to the fuel used in the torch 900, such as steel wool. In one embodiment, the porosity of the foam insert 913 will be such that liquids may pass therethrough with relative ease while vapors passing therethrough will be kept to a relative minimum.

The present embodiment of FIG. 9 provides a vent 908 with a cap 910 attaching to a float 912. The float 912 will tend to elevate the cap 910 when the canister 106 is relatively full of fuel. Therefore, the cap 910 functions as a fullness indicator. The cap 910 will also allow passage of fuel vapors from the canister 106 while preventing entry into the canister 106 of flames from the wick 202 or other ignition sources. Thus, the embodiment shown provides means for refueling the torch 900 without touching the torch 900 and means for preventing entry of ignition sources into the canister 106 while providing ventilation.

Figure 10:
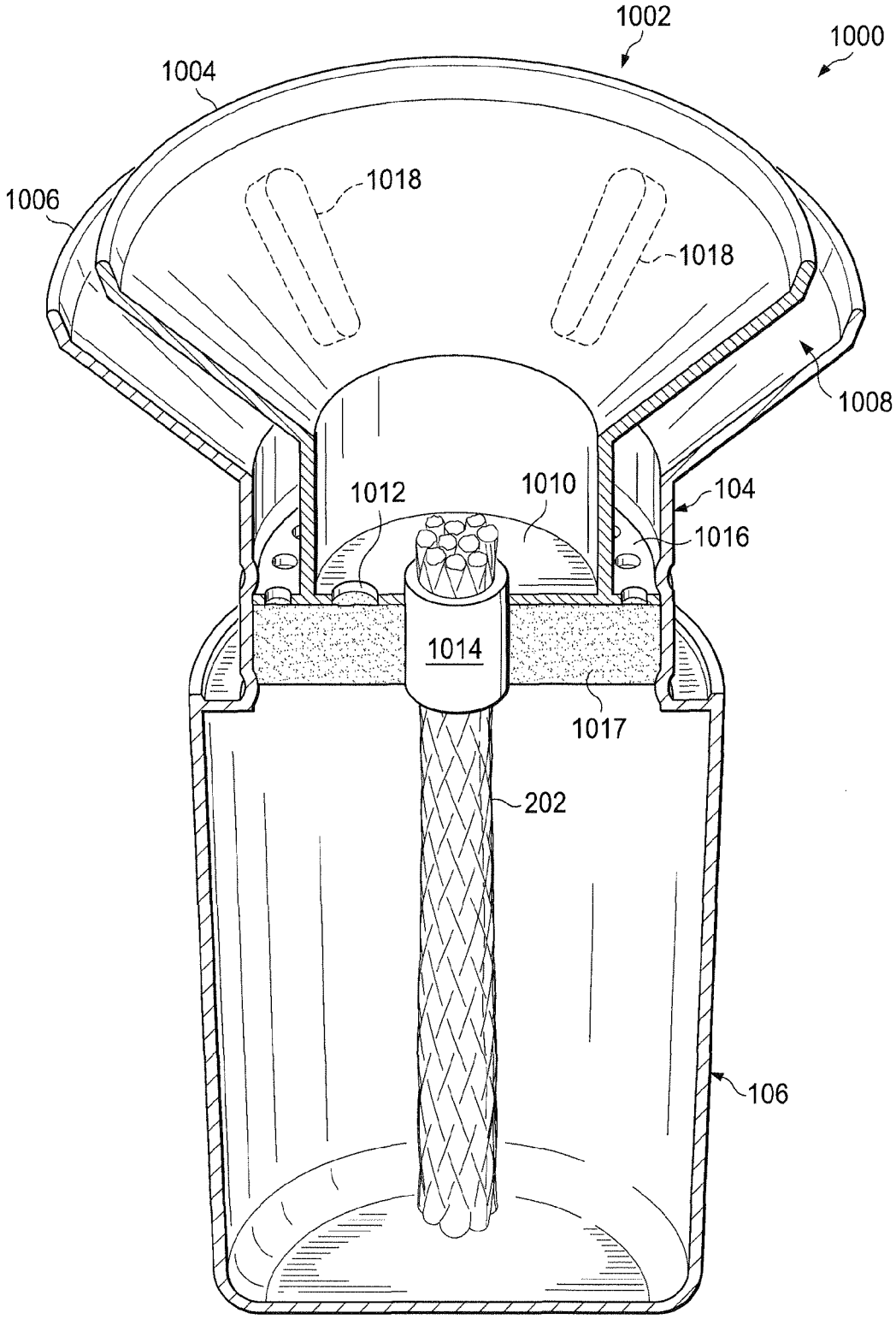
FIG. 10 is a perspective cutaway view of another large flame patio torch according to aspects of the present disclosure.

Referring now to FIG. 10, a perspective cutaway view of another large flame patio torch according to aspects of the present disclosure is shown. The embodiment of FIG. 10 provides a double walled funnel 1002 connecting into the neck 104 and onto the canister 106. In the present embodiment, the funnel 102 comprises an inner funnel wall 1004 and an outer funnel wall 1006. The space between the inner funnel wall 1004 and the outer funnel wall 1006 defines a vent 1008.

In the neck 104 is an inner floor 1010 defining a fill hole 1012. The floor 1010 also provides or otherwise attaches to a collar 1014 operating as a wick holder for the wick 202. In the neck 104, in between the inner funnel wall 1004 and the outer funnel wall 1006 is a baffled floor 1016. Beneath the baffled floor 1016 and the inner floor 1010 is a foam insert 1017. As before, the foam insert 1017 may be any porous material capable of withstanding exposure to liquid torch fuel. The foam insert 1017 serves to pass liquids from the neck 104 of the torch 1000 into the canister 106 while allowing only controlled release of vapors from within the canister 106.

In the present embodiment, the canister 106 may be filled by introducing liquid fuel into the funnel 1002, whether entirely within the inner funnel wall 1004 or between the inner funnel wall 1004 and the outer funnel wall 1006. Fuel will travel through the fill hole 1012 or through the baffled floor 1016, through the foam insert 1017, and into the canister 106. In the present embodiment, ventilation will occur primarily through the foam insert 1017, through the baffled outer floor 1016, and out through the vent 1008, defined by the inner funnel wall 1004 and the outer funnel wall 1006. However, it is contemplated that at least some vapor will escape through the fill hole 1012.

The vent 1008, being defined by the space between the inner funnel wall 1004 and the outer funnel wall 1006, may be maintained simply by the structural rigidity of the funnel walls. In other embodiments, separators or support members 1018 (shown here in phantom) will be used to maintain the appropriate vent size. Thus, in the present embodiment, means are provided for filling the torch 1000 with liquid fuel without the need to actually touch the torch 1000. Means have also been provided for ventilation of the canister 1006 in a controlled manner and preventing entry of ignition sources into the canister 106.

Figure 11:
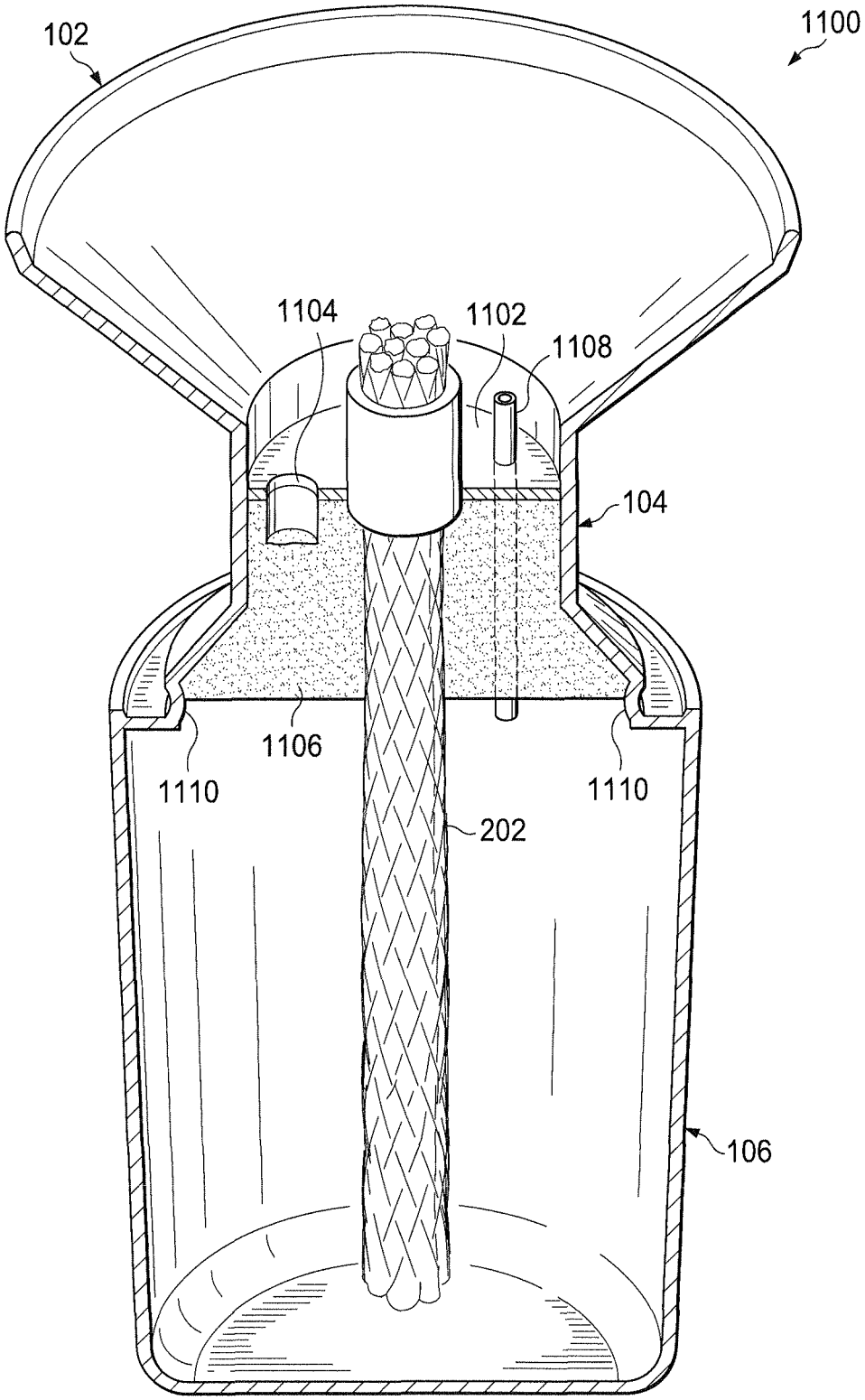
FIG. 11 is a perspective cutaway view of another large flame patio torch according to aspects of the present disclosure.

Referring now to FIG. 11, a perspective cutaway view of another large flame patio torch according to aspects of the present disclosure is shown. The torch 1100 of FIG. 11 provides a funnel 102 attaching to a neck 104 on top of a canister 106. In the neck 104 is a floor 1102 defining a fill hole 1104. A foam filler 1106 is provided in the present embodiment. It can be seen that the foam filler 1106 extends through part of the neck 104 and down into the upper portion of the canister 106. The foam filler 1106 may be any porous material capable of withstanding exposure to liquid torch fuel. A vent tube 1108 is also provided on the floor 1102. As shown in phantom in the drawing, the vent tube 1108 extends through the foam filler 1106. It can also be seen that the fill hole 1104 may sit above a depression or opening in the foam filler 1106 to aid in fueling of the torch 1100. In the present embodiment, a bead or crimp 1110 is provided for securely retaining the foam filler 1106. In other embodiments, the foam filler 1106, which may partially fill the canister 106, may be secured by a friction fit or by other means. Thus, it can be seen in the present embodiment that the torch 1100 provides means for filling the torch without required touching of the torch. Means have also been provided for the controlled release of vapors from the canister 106 and for preventing entry of ignition sources into the canister 106.

Figure 12:
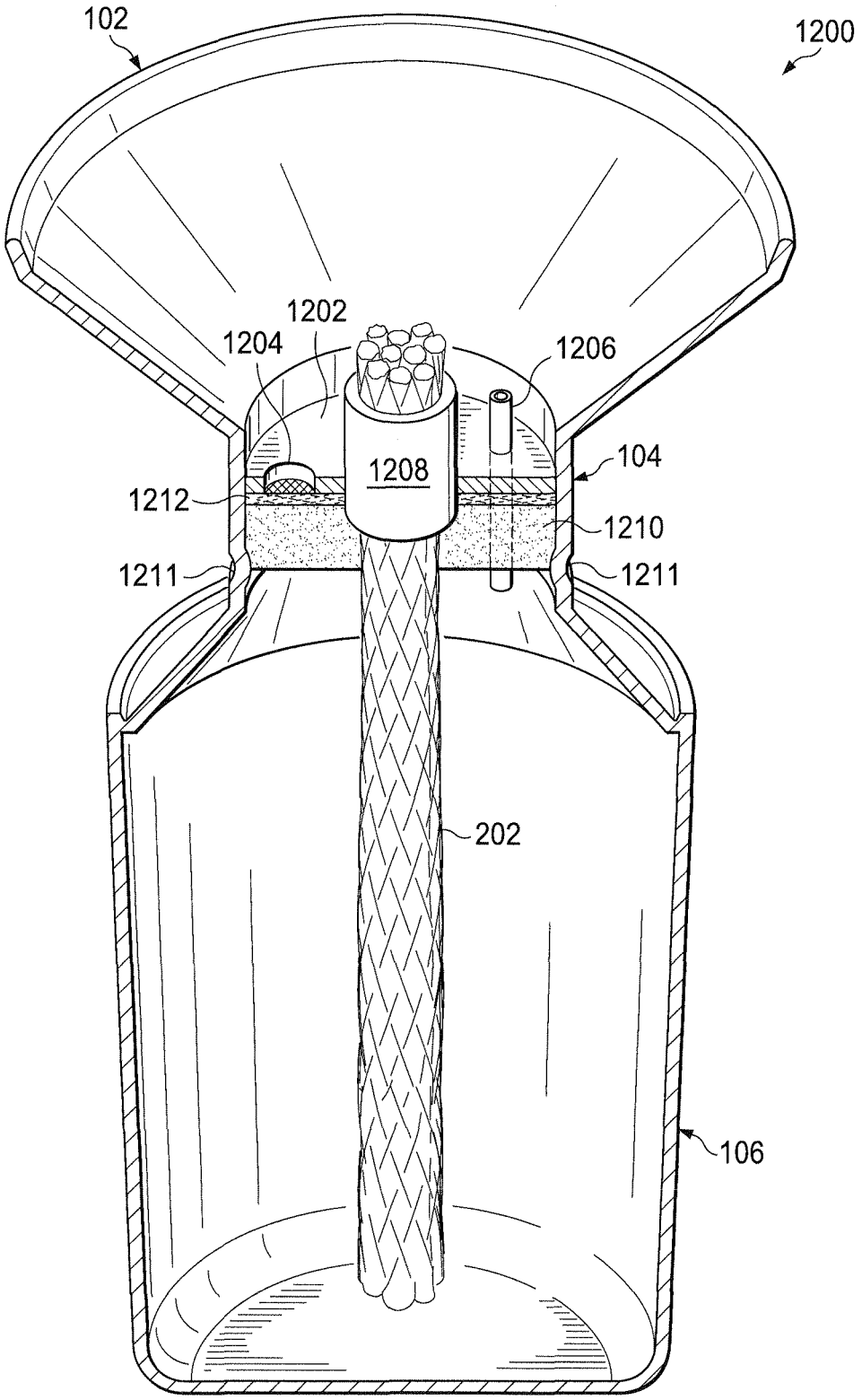
FIG. 12 is a perspective cutaway view of another large flame patio torch according to aspects of the present disclosure.

Referring now to FIG. 12, a perspective cutaway view of another large flame patio torch according to aspects of the present disclosure is shown. The torch 1200 of FIG. 12 provides a funnel 102 attaching to a neck 104 on a canister 106. In the neck 104, a floor 1202 is provided that defines a fill opening 1204. A vent tube 1206 is also provided. The floor 1202 defines or otherwise attaches to a collar 1208, which functions as a wick holder for the wick 202. Below the floor 1202 is a foam insert 1210. The foam insert 1210 may be similar to the foam inserts previously discussed. It can be seen that the vent opening 1206 may extend all the way through the foam insert 1210. A bead or crimp 1211 may be provided on the neck 104 to retain the foam insert 1210. The present embodiment also provides a mesh screen 1212 that sits over the foam insert 1210. This may protect the foam insert 1210 and provide an additional measure of vapor control. Thus, as with previous embodiments, the torch 1200 provides means for allowing the torch 1200 to be filled without the need to touch the torch 1200 while also allowing for only a controlled release of liquid fuel vapors from the canister 106. The present embodiment also provides means for preventing entry of ignition sources into the canister 106.

Figure 13:
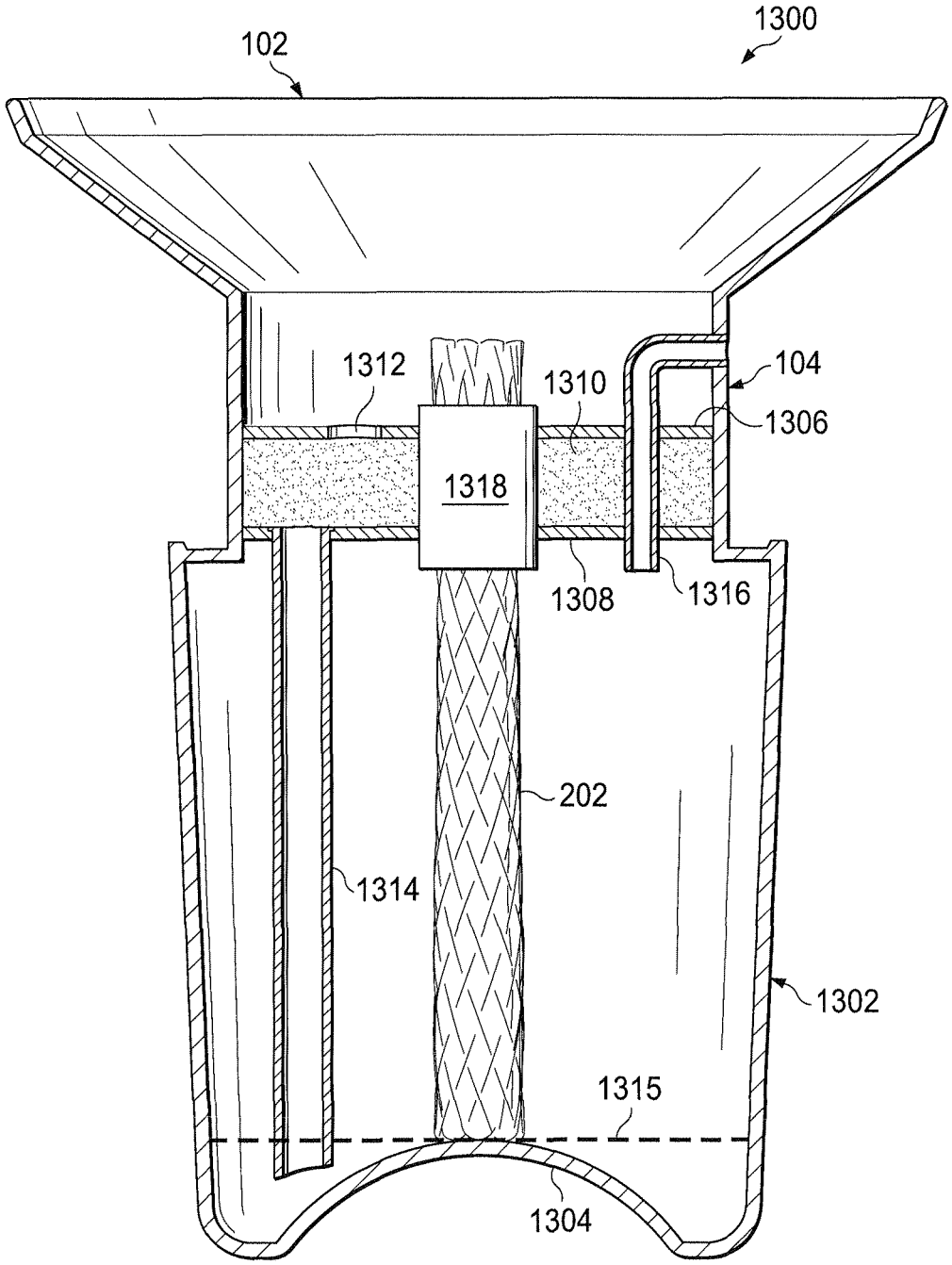
FIG. 13 is a side cutaway view of another large flame patio torch according to aspects of the present disclosure.

Referring now to FIG. 13, a side cutaway view of another large flame patio torch according to aspects of the present disclosure is shown. As with previous embodiments, the torch 1300 provides a funnel or bowl 102 attached to a neck 104. However, the present embodiment provides a different canister 1302 than in previous embodiments. The canister 1302 provides a partially arched or elevated floor 1304. The purpose of the arched floor 1304 will be described in greater detail below.

A floor 1306 is provided in the neck 104 and sits over a foam insert 1310, which may be similar to the foam inserts previously discussed. One embodiment will use steel wool or packing material for the foam insert 606, while another embodiment will provide ball bearings as an insert. Some embodiments may also utilize excess lengths of wicking material as an insert. For example, the wick 202 may not pass straight through the provided collar 1318 but will be arranged in a coiled fashion to substantially fill the void between the floor 1306 and a subfloor 1308.

The floor 1306 defines a fuel fill opening 1312. In the present embodiment, when liquid fuel is poured into the funnel 102 and neck 104, it must pass through the fill hole 1312 through the foam insert 1310. The fuel passes down through a fill tube 1314 attached to the subfloor 1308 and into the canister 1302. It can be seen that the arched floor 1304 provides a minimum level in the canister 1302 into which the wick 202 can settle. In the present drawing, this level is denoted by line 1315. It can be seen that the fill tube 1314 sits below the line 1315. Therefore, when enough liquid fuel is in the canister 1302 to allow wicking by the wick 202 and operation of the torch 1300, the fuel level will be at line 1315 or greater and will therefore seal the fill tube 1314. This will prevent an excess of fuel vapor from traveling back through the foam insert 1310.

In order to adequately ventilate the canister 1302, a ventilation tube 1316 is provided. It can be seen that the ventilation tube 1316 proceeds through the subfloor 1308, the foam insert 1310, and the floor 1306. In the present embodiment, the ventilation tube 1316 vents to the outside of the neck 104. Therefore, the torch 1300, like previously discussed embodiments, provides means for filling the torch 1300 without touching the torch 1300, means for a controlled ventilation of the canister 1302, and means for preventing entry of ignition sources into the canister 1302.

Figure 14:
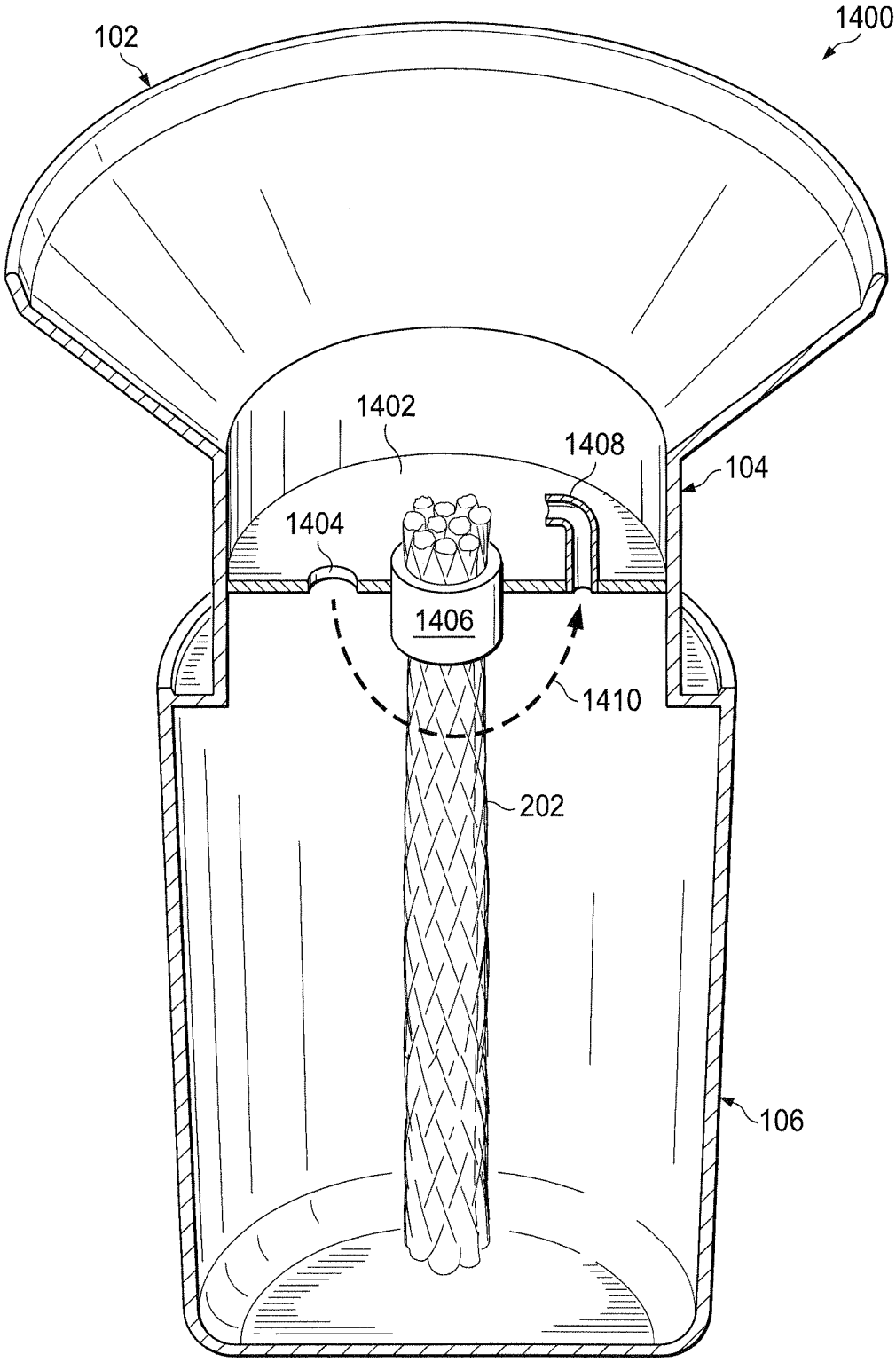
FIG. 14 is a perspective cutaway view of another large flame patio torch according to aspects of the present disclosure.

Referring now to FIG. 14, a perspective cutaway view of another large flame patio torch according to aspects of the present disclosure is shown. The torch 1400 of FIG. 14 provides a bowl or funnel 102 attached to a neck 104, attached to a canister 106. A floor 1402 is provided in the neck 104 and defines a fill hole 1404. The floor 1402 also provides or attaches to a collar or wick holder 1406 for holding the wick 202. A ventilation tube 1408 is provided that attaches to the floor 1402 for ventilating the canister 106. In the present embodiment, the ventilation tube 1408 is directed to the top of the wick 202 where combustion will occur. In this manner, during operation, fumes from the canister 106 will be ignited and burned by the wick 202. In operation, when burning of vapors from the canister 106 occurs, it can be seen that air may be drawn into the canister 106 by the vacuum created by escapement of fumes through the vent tube 1408. The dotted line 1410 approximates one potential path for air flow within the canister 106 when the torch 1400 is in operation.

It can therefore be seen that the torch 1400 provides for the ability to fill the torch 1400 without the need to touch the torch and also provides for controlled ventilation. The continuous ventilation of the canister 106 when the torch is in operation, as well as the size and location of the fill hole 1404 and the ventilation tube 1408 minimizes the opportunity for flames or other ignition sources to travel into the canister 106. Because only air without unburned fuel vapors will be drawn down into the canister 106 through the fill hole 1404, there is little chance of flames or ignition sources traveling through the fill hole 1404. Furthermore, because the fumes from the canister 106 are traveling in an outbound fashion through the bends and curves of the ventilation tube 1408, there is little chance that the flame will travel through the ventilation tube 1408 into the canister 106. Thus, the present embodiment provides means for ventilation without allowing ignition sources into the canister 106.

Referring now to FIG. 15, an illustration of a large flame patio torch in operation according to aspects of the present disclosure is shown. Here, an entire torch assembly 1500 is shown. The previously disclosed torches may be used alone or with a stand as part of an assembly as is shown in FIG. 15. The torch assembly 1500 comprises a torch 1502, and a stand 1504. The torch 1502 may be any of the torches previously described or variations thereof. Here, it can be seen that, due to the amount of fuel provided by the wick and the size and shape of the funnel or bowl, a large flame is provided by the torch 1500. This flame will be larger, provide more light and/or more insect repellent capabilities than previous torch designs. The stand 1504 in the present embodiment is designed to be stabilized by being inserted into a ground surface 1506. However, other embodiments may provide a stand 1504 configured for use on a hard surface.

Although FIG. 15 illustrates a large patio-style torch assembly, the torches of the present disclosure may also be used in other settings. For example, smaller table-top versions may be produced. In addition, large lantern type torch assembly could be constructed using the torches of the present disclosure that are capable of providing even greater amount of light, heart, and/or insect repellent or other capabilities. The torches described herein can also be altered in size and capacity based upon the needs of the user and are not themselves limited to a particular size.

* * * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. An apparatus comprising:

a fuel container;

a flame bowl; and a fill port accessible through the flame bowl and having a plurality of horizontal barriers, each barrier having at least one fuel opening, the plurality of barriers interposing the flame bowl and the fuel container preventing the free flow of combustible gases into or out of the fuel container, whereby the fuel port is always accessible for filling without need for opening the fuel container;

wherein the plurality of horizontal barriers comprises a plurality of horizontal baffled barriers.

2. The apparatus of claim 1, further comprising a wick disposed in the flame bowl proximate the fill port.

3. The apparatus of claim 1, further comprising a fuel full indicator.

4. The apparatus of claim 1, further comprising a ventilation tube extending from the fuel canister.

5. An apparatus comprising:

a fuel container;

a flame bowl; and a fill port accessible through the flame bowl and having a plurality of horizontal barriers, each barrier having at least one fuel opening, the plurality of barriers interposing the flame bowl and the fuel container preventing the free flow of combustible gases into or out of the fuel container, whereby the fuel port is always accessible for filling without need for opening the fuel container;

further comprising a restriction interposing the plurality of horizontal barriers, the restriction being selected from the group consisting of a foam insert, steel wool, ball bearings, packing material, and wicking material.

6. An apparatus comprising:

a fuel canister;

a flame bowl;

a neck joining the fuel canister and the flame bowl, the neck containing a wick holder and a surrounding fuel filling port, the fuel filling port being operable to allow filling of the fuel canister without manipulation of the torch and to control the exit of fuel vapors from the fuel canister while preventing entry of ignition sources into the fuel canister wherein the fuel filling port further comprises:

a baffled floor connecting to the wick holder;

a double-walled fuel flow barrier connecting to a periphery of the baffled floor, an inner wall of the barrier being solid and an outer wall of the barrier facing an inner portion of the neck and being baffled on a portion thereof; and a baffled shelf below the baffled floor having a passage for passing the wick therethrough into the fuel canister.

7. The apparatus of claim 6, further comprising a wick in a friction fit in the wick holder.

8. The apparatus of claim 6, further comprising a stand for receiving and elevating the torch.

* * * * *